US006478489B2

(12) United States Patent
Hierro

(10) Patent No.: US 6,478,489 B2
(45) Date of Patent: Nov. 12, 2002

(54) PRINTER ROLLFEED MEDIA TENSION SYSTEM WITH FRICTION RING

(75) Inventor: Lluis Hierro, Barcelona (ES)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/774,820

(22) Filed: Jan. 31, 2001

(65) Prior Publication Data

US 2002/0102122 A1 Aug. 1, 2002

(51) Int. Cl.[7] ..... B41J 15/16

(52) U.S. Cl. ..... 400/618; 101/DIG. 42; 242/421; 242/422; 242/422.4

(58) Field of Search ..... 242/421, 421.8, 242/422, 422.4, 422.9; 101/DIG. 42, DIG. 41; 400/618

(56) References Cited

U.S. PATENT DOCUMENTS

| | | | | | |
|---|---|---|---|---|---|
| 1,103,144 | A | * | 7/1914 | Hunting | 242/156 |
| 2,095,307 | A | * | 10/1937 | Ball et al. | 188/83 |
| 3,306,550 | A | * | 2/1967 | Ewing | 242/573.5 |
| 5,562,034 | A | | 10/1996 | Fox | 101/228 |
| 6,102,323 | A | * | 8/2000 | Riemenschneider | 242/422.4 |

FOREIGN PATENT DOCUMENTS

| | | | | |
|---|---|---|---|---|
| DE | 2207130 | | 8/1973 | |
| DE | 19514599 | A1 * | 10/1996 | B41J/33/52 |
| EP | 0905072 | A1 | 3/1999 | |
| GB | 1287039 | | 8/1972 | |
| GB | 1370608 | A * | 10/1974 | A47K/10/32 |
| GB | 8606662.5 | | 5/1986 | |
| JP | 63218459 | A1 * | 9/1988 | B41J/15/16 |
| JP | 2000191194 | A * | 7/2000 | B41J/15/16 |

* cited by examiner

*Primary Examiner*—Daniel J. Colilla

(57) ABSTRACT

A rollfeed braking system for maintaining substantially constant tension in rollfeed media includes a rotary brake drum on a rollfeed mounting spindle assembly and a pivotally mounted spring biased brake arm having a braking area urged toward the brake drum. A friction ring is mounted on the exterior surface of the brake drum so that frictional braking force is applied to the drum by the friction ring rather than by brake shoes as is conventional. Substantially constant tensioning of the media results since roll replacement does not require the operator to contact the exterior surface of the brake drum which leaves contamination thereon in the form of fingerprint oil, grease or other contaminants.

19 Claims, 2 Drawing Sheets

PRINTER ROLLFEED MEDIA TENSION SYSTEM WITH FRICTION RING

CROSS REFERENCE TO RELATED APPLICATIONS

None.

BACKGROUND OF THE INVENTION

The present invention relates to the art of printing onto rollfeed media and, more particularly, to a media roll support spindle and brake mechanism which reliably governs tensioning of the media. One prior art example of rollfeed spindle and braking device for rollfeed media is disclosed in published European Patent Publication 0 905 072 owned by the assignee of the present invention. Since the rollfeed media should be pulled from the roll with a substantially constant or at least a controllable amount of tension, a spindle brake which uses a stainless steel brake drum engageable with a spring biased pivotally mounted brake shoe has been employed for this purpose. It has been noticed that undesired alteration of the designed amount of back tensioning of the media frequently results from repeated handling of the spindle assembly. This has now been determined to be the result of finger contact with the cylindrical surface of the brake drum which often takes place as the media support spindle is removed from the printer cabinet to replace a media roll leaving fingerprint oil or grease or other contamination on the surface of the metal brake drum which alters the coefficient of friction and hence the tension of the media roll.

It is accordingly the objective of the present invention to overcome this problem and achieve relatively constant tensioning of the rollfeed media.

SUMMARY OF THE INVENTION

The present invention therefore provides a rollfeed media tensioning system for a printer, said system comprising a rotary media roll support spindle which includes a brake drum and a spindle brake mechanism including at least one brake surface for braking rotation of said spindle, said system further comprising a friction ring mounted on said brake drum and positioned for engagement by said brake surface to urge said friction ring into engagement with said brake drum to brake rotation of said spindle.

The present invention further provides a printer including a support for a supply of rollfeed media to be pulled from said roll to a station at which printing on said media takes place and a rollfeed media tensioning system comprising a rotary media support spindle which includes a brake drum and a spindle brake mechanism, said spindle brake mechanism including a friction ring mounted on said brake drum, and at least one contact surface engaging said friction ring with a predictable amount of force to urge said friction ring into frictional engagement with said brake drum to brake rotation of said spindle.

DETAILED DESCRIPTION OF THE PREFERRED EMBODIMENTS

Figure 1:
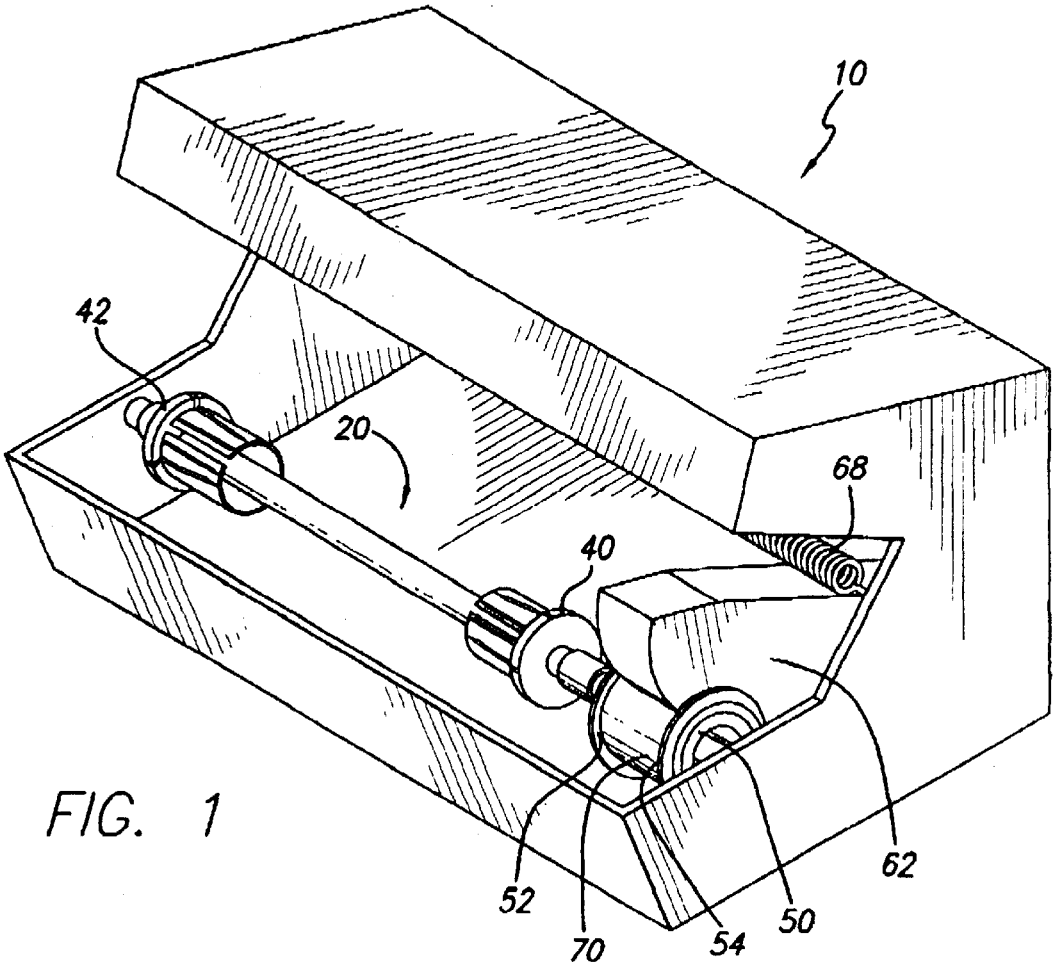
FIG. 1 is a schematic front elevation view of a printer which uses rollfeed media.

A printer chassis or housing 10, shown schematically in FIG. 1, includes a frontal roll access opening which may be closed by a door, not shown, so that rollfeed media can easily be replaced as necessary. The details of the operative portions of the printer, other than the rollfeed media spindle and media tensioning system, not being essential to an understanding of the present invention, are therefore omitted from the drawings and following description.

A rotary media roll support spindle assembly 20 extends transversely of the printer and is shown in the form of an elongated shaft 30 preferably having longitudinally spaced shaft support bearings or hubs 32, 34 which are, respectively, received in suitably configured shaft support cradles in the printer chassis or housing 10. The spindle assembly 20 also includes spaced media roll support clamps 40, 42 mounted on the shaft 30 for longitudinal sliding movement of one or both of the clamps 40, 42 along the shaft 30 to accommodate media rolls of varying widths. The details of various types of clamps and the manner of affixation of the clamps 40, 42 to the shaft 32 are well known to persons skilled in the art, one such example being disclosed in published European Patent Publication EP 0 905 072.

Figure 2:
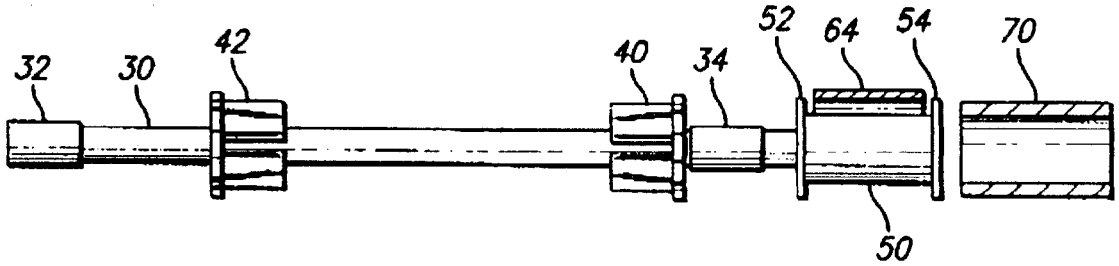
FIG. 2 is a side elevation view of the paper feed and back tension mechanism.

The shaft braking mechanism includes a brake drum 50 which either may be formed integrally with the shaft 30 or comprise a separate part connected to the shaft 30. As shown, the drum 50 is located at one end of the shaft but this is not essential. Although a right hand shaft support bearing 34 is shown in FIG. 2 located between the brake drum 50 and the clamp 40, the brake drum 50 can also function as a shaft bearing so that a separate shaft bearing or hub 34 is not essential. Alternatively, a separate shaft bearing 34 can easily be placed at or near the end of the shaft to the right of the brake drum 50 if desired.

Figure 3:
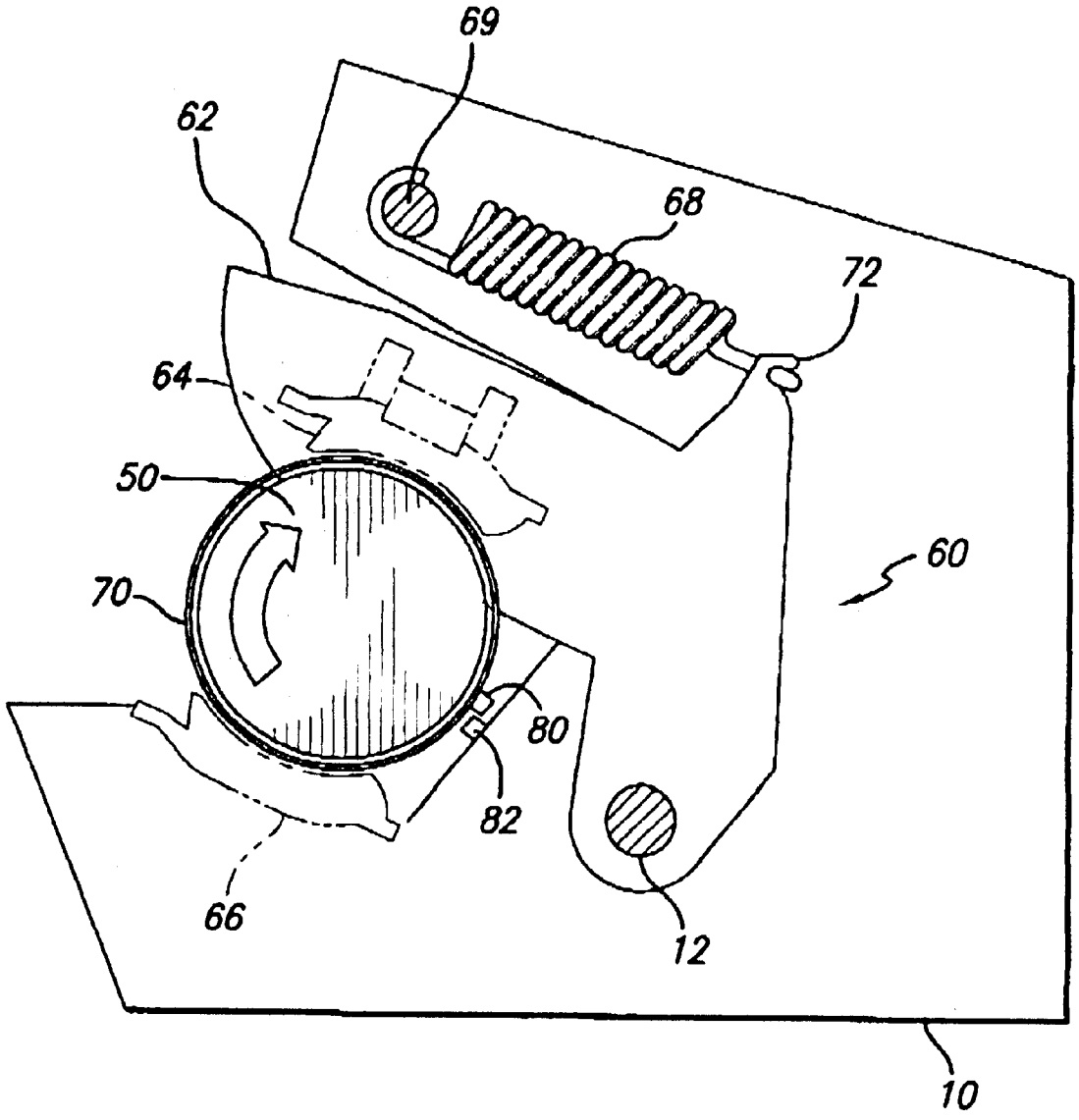
FIG. 3 is front elevation view of the paper support roller and back tension system.

The presently preferred form of shaft brake 60, best seen in FIG. 3, includes a brake arm 62 pivotally mounted on a shaft 12 affixed to the printer chassis 10. In the prior art arrangement, a brake shoe 64 (shown in phantom since it is not essential to the present invention) having an annular braking surface with a known coefficient of friction is suitably mounted in a recess on the brake arm 62 and is urged toward the brake drum 50 to brake the drum 50 with a known amount of force governed primarily by the strength of a spring 68 connected at one end to an anchor post 69 which is affixed to the printer chassis 10 and at the other end to a spring anchor hook 72 on the brake arm 62. A second brake shoe 66, also shown in phantom since it is not essential to the present invention, diametrically opposed across the brake drum 50 from the first brake shoe 54, may also be provided in a suitable recess in the printer chassis 10 in the typical prior art arrangement.

Pursuant to the present invention a plastic, preferably deformable, friction ring 70 is slidably mounted on the exterior annular surface of the brake drum 50 so that separate brake shoes 64, 66, usually made of material different than the material of which the brake arm 62 is manufactured, are unnecessary since the arm 62 is urged by the spring 68 to bring the brake surface area of the arm 62 into radial essentially nonfriction contact with the exterior surface of the friction ring 70 rather than into direct rubbing contact with the annular surface of the brake drum 50. The friction ring 70 is held in place on the brake drum 50 for example by flanges 52, 54 at either end of the brake drum 50 between which the friction ring 70 is restrained, so that when the spindle assembly 20 is removed from the printer housing 10 for replacement of a media roll, the operator can grasp the exterior surface of the flexible friction ring 70 and does not need to touch the annular metal braking surface of the brake drum 50. As a result of use of the friction ring 70 to apply braking force to the brake drum 50, the spindle braking remains essentially constant since the inner contact surface of the ring 70 and outer annular surface of the drum 50 remain uncontaminated by fingerprint oil, grease or other contaminants during handling of the spindle assembly 20. The separate brake shoes 64, 66 and recesses in which they are mounted are now unnecessary and can be eliminated for cost reduction. Preferably, a rotation stop 80 is provided on the exterior surface of the friction ring which engages a rotation stop surface 82 on the printer chassis 10 to prevent rotation of the friction ring 70 relative to the chassis 10.

The friction ring 70 may be formed with an axially extending slot so that the ring 70 can be deformed by opening its C-shape for mounting on the brake drum 50 between the flanges 52, 54. Alternatively, the end flange 54 may be removably attached to the drum 50 so that the ring 70 can be axially slid onto the drum. The wall thickness and material of the friction ring 70 are determined so that the ring 70 is preferably easily deformed under application of pressure by the brake arm 62 on one side of the ring 70 and the chassis 10 on the other side of the ring 70 to push opposite sides of the ring 70 into braking engagement with the annular surface of the drum 50. Deformability of the ring 70 is not, however, essential since the ring 70 can simply be pushed by the arm 62 into braking engagement with only one area of the drum 50 without engagement of the ring 70 by the chassis 10 on the diametrically other side of the brake drum 50 if desired. Without limitation, a metallic brake drum 50 encircled by a friction ring 70 of low friction plastic of approximately 0.5 mm wall thickness has been found to perform satisfactorily in tests.

Although the brake mechanism shown and described employs a spring biased pivotally mounted arm 62 to exert braking force against the exterior surface of the friction ring 70, a pivotally mounted arm is not essential and various other functional equivalent structures may be used instead such, for example, as spring biased linearly moveable brakes.

Persons skilled in the art will also appreciate that various additional modifications can be made in the preferred embodiment shown and described above and that the scope of protection is limited only by the wording of the claims which follow.

What is claimed is:

1. A rollfeed media tensioning system for a printer, said system comprising a rotary media roll support spindle which includes a rotary brake drum thereon and a spindle brake mechanism including at least one brake surface for braking rotation of said spindle, said system further comprising a friction member mounted on said brake drum and positioned for engagement by said brake surface to urge said friction member into engagement with said brake drum to brake rotation of said spindle.

2. The tensioning system of claim 1, further comprising a rotation stop on said friction member engageable with a printer chassis for preventing rotation of said friction member relative to said printer chassis.

3. The tensioning system of claim 1, further including a second brake surface engageable with said friction member to deform said friction member into engagement with said brake drum to brake rotation of said spindle.

4. The tensioning system of claim 3, wherein said second brake surface is located diametrically across said brake drum from said at least one brake surface.

5. The tensioning system of claim 1, wherein said spindle brake mechanism includes a pivotal brake arm, said brake surface being provided on said arm, and a spring connected to said arm and to printer structure for pivoting said arm to urge said brake surface into engagement with said friction member on said brake drum.

6. The tensioning system of claim 5, wherein said spindle assembly is comprised of a roll support shaft and at least one adjustable media clamp on said shaft for clamping different size rolls of media onto said shaft.

7. The tensioning system of claim 6, wherein said brake drum is integrally formed on said shaft, said shaft and brake drum being made of metal and said friction member being made of plastic.

8. The tensioning system of claim 7, wherein said brake drum is at one end of said shaft and further comprising spaced shaft support hubs on said shaft.

9. The tensioning system of claim 1, wherein said friction member comprises a friction ring.

10. The tensioning system of claim 9, wherein said ring is deformable.

11. The tensioning system of claim 10, wherein said ring has an axially extending slot therein.

12. A printer having a chassis and including a support for a supply of rollfeed media to be pulled from said roll to a station at which printing on said media takes place and a rollfeed media tensioning system comprising a rotary media support spindle which includes a rotary brake drum thereon and a spindle brake mechanism, said spindle brake mechanism including a friction ring mounted on said brake drum, and at least one contact surface engaging said friction ring with a predictable amount of force to urge said friction ring into frictional engagement with said rotary brake drum to brake rotation of said spindle.

13. The printer of claim 12, further comprising engageable stops on said friction ring and on said printer chassis for preventing rotation of said friction ring relative to said printer chassis.

14. The printer of claim 12, further including a second contact surface engaging said friction ring to deform said friction ring into engagement with said brake drum to brake rotation of said spindle.

15. The printer of claim 14, wherein said second contact surface is located diametrically across said brake drum from said at least one contact surface.

16. The printer of claim 12, wherein said tensioning system includes a brake arm pivotally connected to a printer chassis, said at least one contact surface being on said arm, and a spring connected to said arm and connected to said printer chassis for pivoting said arm to urge said at least one contact surface into engagement with said friction ring on said brake drum.

17. The printer of claim 16, wherein said spindle assembly is comprised of a roll support shaft and at least one adjustable media clamp on said shaft for clamping different size rolls of media onto said shaft.

18. The printer of claim 17, wherein said brake drum is at one end of said shaft and further comprising axially spaced shaft support hubs on said shaft, said support hubs being received in shaft supports on said printer chassis.

19. The printer claim 12, wherein said brake drum is integrally formed on said shaft, said shaft and brake drum being made of metal and said friction ring being made of plastic.

* * * * *